US005602442A

United States Patent [19]

Jeong

[11] Patent Number: 5,602,442

[45] Date of Patent: Feb. 11, 1997

[54] CATHODE RAY TUBE HAVING A METAL OXIDE FILM OVER A BLACK MATRIX

[75] Inventor: Hae-Beob Jeong, Seoul, Rep. of Korea

[73] Assignee: Goldstar Co., Ltd., Seoul, Rep. of Korea

[21] Appl. No.: 350,164

[22] Filed: Nov. 30, 1994

[30] Foreign Application Priority Data

Dec. 1, 1993 [KR] Rep. of Korea ..... 1993-26141

[51] Int. Cl.[6] ..... H01J 29/28; H01J 29/10

[52] U.S. Cl. ..... 313/466; 313/473; 445/52

[58] Field of Search ..... 313/466, 461, 313/474, 473; 445/52

[56] References Cited

U.S. PATENT DOCUMENTS 4,717,856 1/1988 Kato ..... 313/466

5,141,461 8/1991 Nishimura et al. ..... 313/466

*Primary Examiner*—Michael Horabik
*Assistant Examiner*—Michael Day
*Attorney, Agent, or Firm*—Spencer & Frank

[57] ABSTRACT

A color cathode ray tube includes a black matrix layer formed on the flat portion of a glass panel, a patterned metal oxide layer formed on the black matrix layer, a fluorescent layer formed on the patterned metal oxide layer and directly on the glass panel therebetween, and a metal reflection layer formed on the fluorescent layer on both the curved and flat portions of the glass panel, wherein the mean particle size of the metal oxide is larger than the mean particle size of the black matrix. The relative particle size of the metal oxide and the black matrix provides for increased adhesion of the reflective metal layer, and alleviates problems with outgassing of the black matrix.

5 Claims, 3 Drawing Sheets

CATHODE RAY TUBE HAVING A METAL OXIDE FILM OVER A BLACK MATRIX

FIELD OF THE INVENTION

The present invention relates to color cathode ray tube, more particularly to fluorescent plate of color cathode ray tube and process thereof for raising an adhesive intensity of effective plane by forming metallic oxide layer on the black matrix layer, and for easily exhausting gases through pores formed at metallic reflection layer of non-effective plane.

BACKGROUND OF THE INVENTION

Referring to FIG. 1, this is a sectional view showing color cathode ray tube including the fluorescent plate in accordance with conventional art.

The manufacturing process of above fluorescent plate is described as follows.

At first, a photoresist liquid is homogeneously coated onto the surface of a glass panel 1. After the coating of the photoresist liquid, fits a shadow mask 3 with the glass panel 1 and operates an exposure for discriminating red(hereinafter referred to as "R"), green(hereinafter referred to as "G") and blue(hereinafter referred to as "B") fluorescent portions 4.

After the exposure process, one develops a exposed pattern in pure water. After the above processes, one can obtain a pattern of photoresist membrane from which non-exposed portions are eliminated.

After coating the black matrix layer 3 of non-fluorcent absorption material onto the surface of said photoresist layer, unnecessary black matrix layer portions onto the glass panel 1 are removed by hydrofluoric acid, HF solution.

Black matrix layer equivalent to three colors, R, G and B is formed onto the photoresist layer from the etching process.

After the deposition process of the black matrix layer, a deposition process of a fluorescent layer is deposited onto the black matrix layer and the glass panel onto which the black matrix layer is not formed, where the deposited fluorescent layer is discriminated with R, G and B portions. As shown in FIG. 1, each fluorescent portions formed from the above processes has a pattern stretched over black matrix islands.

After the coating process of the fluorescent material, a metallic reflection layer should be deposited onto the surface of the fluorescent layer.

At this time, in order to level the deposited metallic reflection layer, organic film layer is applied onto the fluorescent layer, prior to the metallic layer deposition process.

After that process, an unnecessary organic film layer is removed by thermal decomposition at high temperature of 450° C.

When the organic film is decomposed, various kinds of gases are generated, and the generated gases are exhausted outward through pores in the metallic reflection layer.

Here, a role of the metallic reflection layer 5 is to enhance brightness in the cathode ray tube.

However, in using this conventional processes to fabricate the fluorescent plate, there is a problem that the fluorescent layer is easily not attached on the surface of the black matrix layer because the black matrix layer is composed of small particles having mean diameters of 0.1–0.7 μm, and the surface of the black matrix layer is slippery.

In order to prevent this problem, there has been a method for coating the fluorescent material after deposition of a silica component onto the black matrix.

However, this method also has the problem that the fluorescent layer comes apart.

Moreover, when gases are exhausted during the thermal decomposition of the organic film, in case of effective parts $S_e$, gases are smoothly exhausted because of pores generated by unevenness of the black matrix surface, but in case of noneffective part $S_{ne}$, are not smoothly discharged.

That is, in case of $S_{ne}$, gases generated during the thermal decomposition, collide with the attached metallic lower surface, thereby the metallic reflection layer is expanded and partially separated from the surface of the attached black matrix layer. Accordingly, adhesive strength of the metallic layer is decreased, so that the layer is easily separated by bombardment.

The separated metallic layer causes an inner discharge and has a fatal effect on the operation of the cathode ray tube.

SUMMARY OF THE INVENTION

An object of the present invention is to provide a fluorescent plate for a color cathode ray tube and a process therefor for raising the adhesive intensity of an effective plane by forming a metallic oxide layer on a black matrix layer.

Another object of the present invention is to provide a fluorescent plate for a color cathode ray tube and a process therefor for easily exhausting gases by forming pores in a metallic reflection layer.

This object can be accomplished by a fluorescent plate comprising a black matrix layer formed on an effective plane of a glass panel at regular intervals, the black matrix layer having a regular pattern, a metallic oxide layer formed on a patterned black matrix layer, a mean particle size of the metal oxide being larger than that of the black matrix, a fluorescent layer formed on patterned metal oxide layer and therebetween and a metal reflection layer formed on the fluorescent layer taken along an effective and a non-effective plane of said glass panel, wherein the effective plane is a flat portion and a non-effective plane is a curved one.

Other object of the present invention can be accomplished by a fabrication process comprising steps of formation of a light absorption material, black matrix layer on the glass panel, patterning said black matrix layer, formation of a metallic oxide layer on said patterned black matrix layer, a mean particle size of the metallic oxide being larger than that of the black matrix, formation of a fluorescent layer on the patterned metal oxide layer and therebetween and formation of a metal reflection layer on the fluorescent layer taken along an effective and a non-effective plane of said glass panel, wherein the effective plane is a flat portion and non-effective plane is a curved one of the color cathode ray tube.

DETAILED DESCRIPTION OF THE PRESENT INVENTION

This invention will now be described with reference to FIGS. 2, 3 and 4.

Figure 1:
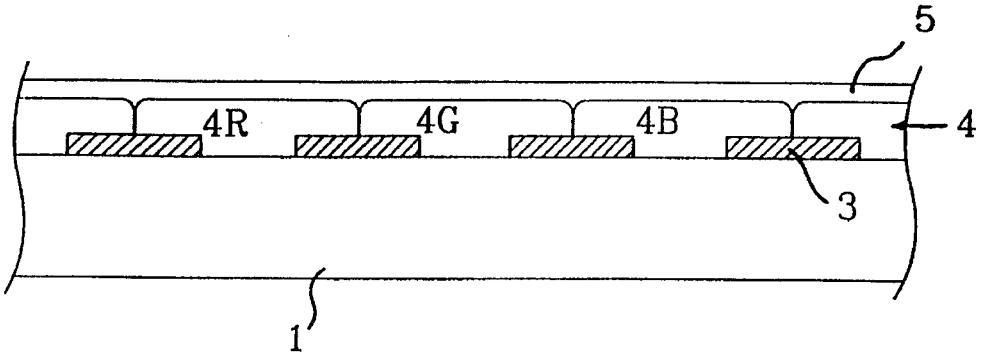
FIG. 1 (PRIOR ART)
FIG. 1 is a partial sectional view of a color cathode ray tube including fluorescent face in accordance with the conventional art.
Figure 2:
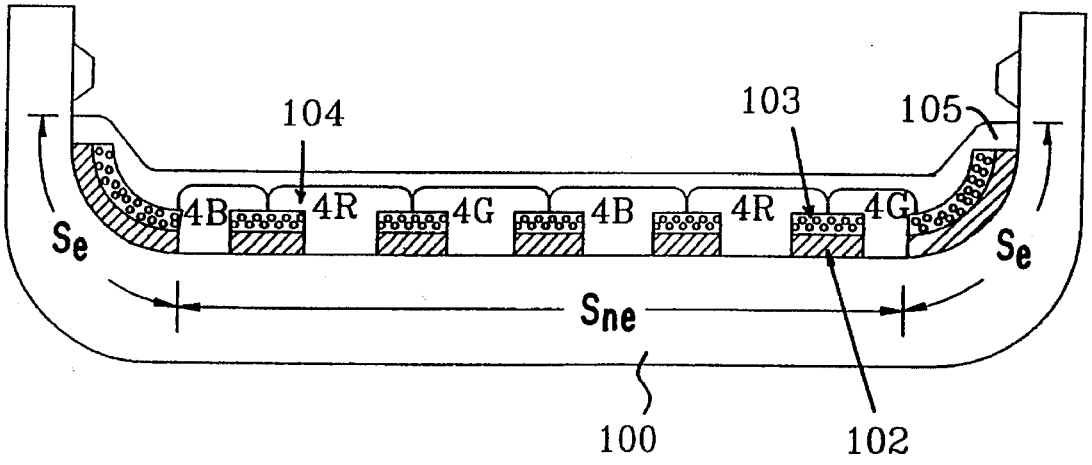
FIG. 2 is a partial sectional view of a color cathode ray tube including fluorescent face in accordance with the present invention.

Referring to FIG. 2 and FIG. 3, these drawings are a partial sectional view of a color cathode ray tube including fluorescent face 104 and a process flow view respectively in accordance with the present invention.

First, as shown in the process flow view of FIG. 3, one homogeneously applies V liquid to the surface of a glass panel 100.

After that process, a shadow mask fits with the glass panel 100 and operates an exposure for discriminating R, G and B fluorescent parts.

After the exposure process, an exposed pattern develops in pure water. After the development process, one can obtain a pattern of the photoresist layer 101 from which non-exposure portions are removed, and only the exposed portions remain.

After the development process is completed, a light absorption material is deposited onto the photoresist layer of the remaining portions so that the photoresist layer is remains. The photoresist layer has been removed by development.

Figure 3A:
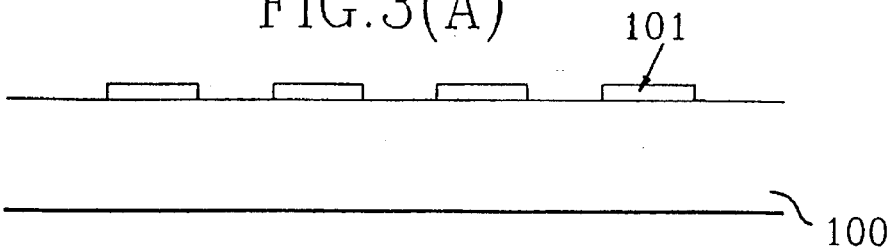
FIGS. 3A–3D are process flow view of the fluorescent plate in a color cathode ray tube in accordance with the present invention.
Figure 3B:
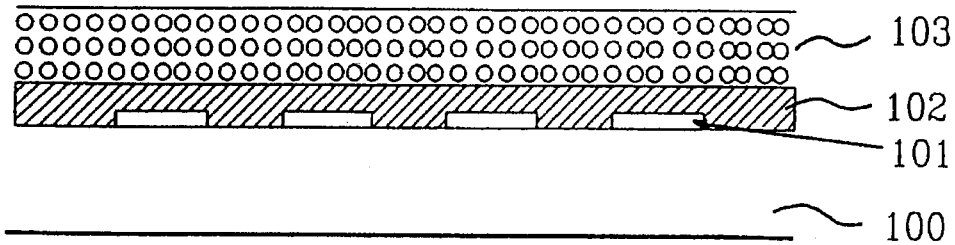
Figure 3C:
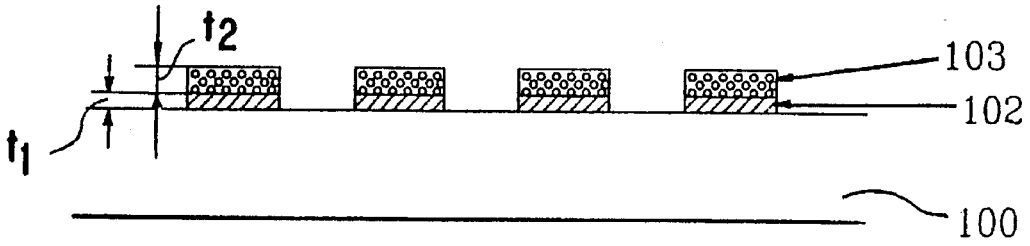

As shown in FIG. 3B, after the deposition of the light absorption material, a black matrix layer 102 is formed by patterning.

After the above process, a metallic oxide material is deposited onto the surface of the black matrix layer.

Here, the thickness $t_2$ of the metallic oxide layer should be thicker than the thickness $t_1$ of the black matrix layer 102, where the thickness $t_2$ has a range of 3–10 μm. When the thickness $t_2$ is less thick than 3 μm, the metallic oxide layer is not coated easily onto the black matrix layer, whereas, when the thickness $t_2$ is thicker than 10 μm, a spot is generated on the upper surface of the metallic layer. Therefore, the thickness must have a range of 3–10 μm.

Moreover, the metallic oxide must be durable to be able to endure a high temperature of 450° C., not to be melted.

The oxidized magnesium MgO, Alumina $Al_2O_3$, deoxidized Titanium $TiO_2$ and zinc oxide ZnO etc are used as the metallic oxides so that gases are not exhausted by light projection.

In addition, the predescribed oxides such as MgO, $Al_2O_3$, $TiO_2$ and ZnO must have a somewhat big particle size with the range of 0.4–0.5 μm in comparison with the mean size of the particle of the light absorption material.

A soluble coupling material, for example, silane or titanate is added to the metallic oxide and is dispersed with the oxides in water, where the soluble coupling material has an adhesive property and, concurrently hydrophilicity and hydrophobicity.

High polymer material, like poly-vinyl alcohol, is also added to the oxide material. Material having a slurry phase is formed by such additives, and the formed slurry phase is deposited onto the black matrix layer 102.

In order to obtain an optimized thickness of the metal oxide layer, the concentration of the metal oxide is in the range of 10–30 w %.

If the concentration of the metallic oxide is less than 10 wt %, it is difficult to form a membrane of metallic oxide, whereas, if the concentration is more than 30 wt %, the formed membrane is not homogeneous and a stain is generated in the formed membrane.

Moreover, the concentration of the hydrogen ion pH must be adjusted in the range of 9–11. If the pH concentration is lower than 9 or is higher than 11, a dispersive property is decreased.

Figure 4:
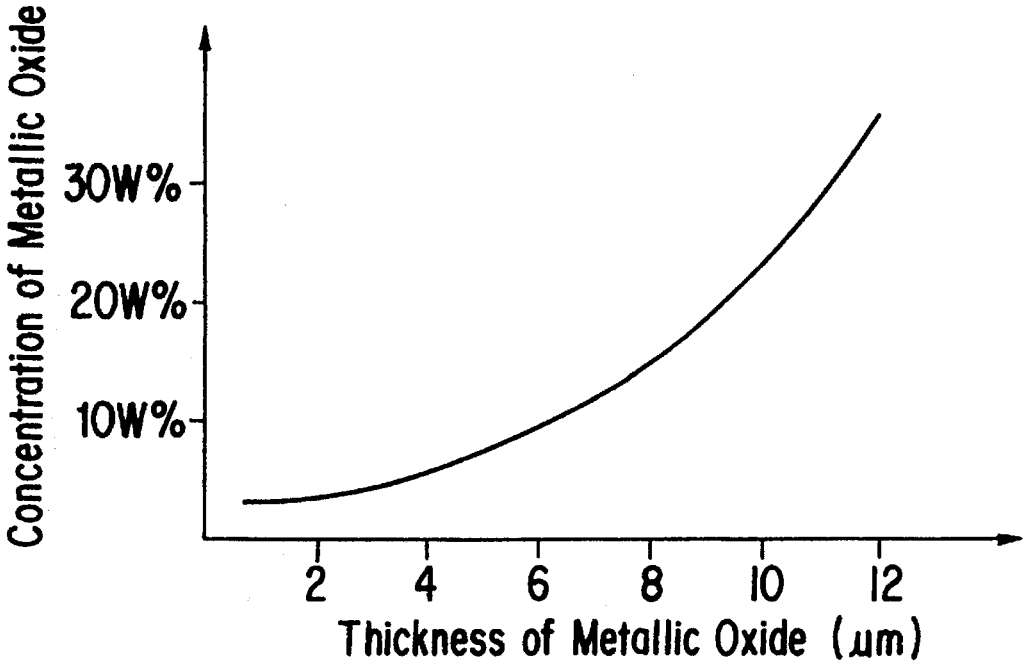
FIG. 4 is a schematic diagram showing a relation between concentration and thickness of a metallic oxide in accordance with the present invention.

Referring to FIG. 4, this is a schematic diagram showing a relation between the concentration of the metallic oxide and thickness of the metallic oxide layer. As shown in the diagram, the concentration of the metallic oxide and the thickness of the metallic oxide layer has an exponential relation.

A mixed liquid with the above parameters is coated on the black matrix layer 102 by a conventionial spin coating method. In order to obtain 3–11 μm, the desired thickness of the metallic oxide 103, as shown in FIG. 3A, a user should appropriately adjust the number of rotations, the time of rotation and the temperature for drying the coated panel.

Figure 3D:
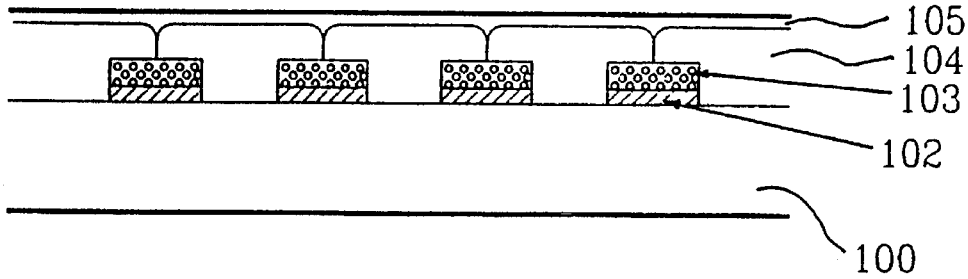

After the coating of the metallic oxide layer 103, as shown in FIG. 3D, the fluorescent material with slurry phase is coated on the metallic oxide layer 103 and the glass panel where the metal oxide layer and the black matrix layer were removed, so that red fluorescent membrane 4R, green fluorescent membrane 4G and blue fluorescent membrane 4B are formed.

After the coating of an organic film membrane 105, such as acrylic emulsion, lacquer etc. on the fluorescent layer 104, a metalback layer of a metal reflection layer is formed on the organic film membrane. After the coating step of the metalback layer, it is annealed at high temperature of 450° C., so that the unnecessary organic film membrane is decomposed and gases generated by decomposition of the organic film are exhausted through pores formed in the metal reflection layer. After the exhaustion of gases, a complete fluorescent plate is formed.

As hereinbefore described, the present invention can provide an effect enabling to raise an adhesive intensity by prominence and depression formed at the non-effective plane due to the metallic oxide layer. Moreover, the present invention can easily exhaust gases generated by thermal decomposition without friction with the metallic reflection layer. In conclusion, the present invention can overcome problems related with adhesion of the metallic reflection layer in conventional art.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A fluorescent plate of color cathode ray tube comprising:

(a) a black matrix layer formed on an effective plane of a glass panel at regular intervals, said black matrix layer having a regular pattern having mean particle diameter between about 0.1 and 0.7 μm;

(b) a metallic oxide layer formed on said patterned black matrix layer, a mean particle size of said metal oxide being larger than that of said black matrix; wherein said metallic oxide has a thickness range of from greater than 3 to 10 μm and a mean particle size range of 0.4–1.5 μm.

(c) a fluorescent layer formed on said patterned metal oxide layer and directly on the glass panel therebetween; and (d) a metal reflection layer formed on said fluorescent layer taken along effective and non-effective plane of said glass panel, wherein said effective plane is a flat portion and non-effective plane is a curved one.

2. The fluorescent plate as set forth in claim 1, wherein said metallic oxide has a composition of one of MgO, $Al_2O_3$, $TiO_2$ or ZnO.

3. A fluorescent plate as set forth in claim 1, wherein high polymer material is included with the metallic oxide layer.

4. A fluorescent plate as set forth in claim 3, wherein polyvinyl alcohol is used as the high polymer material.

5. A fluorescent plate as set forth in claim 1, wherein the metallic oxide layer is formed exclusively over said patterned black matrix layer.

* * * * *